US009889366B2

(12) United States Patent
Bowman

(10) Patent No.: US 9,889,366 B2
(45) Date of Patent: Feb. 13, 2018

(54) APPARATUS AND METHOD FOR SPORTS THROWING CAGE

(71) Applicant: Trevor Bowman, Tallai (AU)

(72) Inventor: Trevor Bowman, Tallai (AU)

( * ) Notice: Subject to any disclaimer, the term of this patent is extended or adjusted under 35 U.S.C. 154(b) by 0 days.

(21) Appl. No.: 14/614,419

(22) Filed: Feb. 5, 2015

(65) Prior Publication Data

US 2016/0236063 A1 Aug. 18, 2016

(51) Int. Cl.

| | |
|---|---|
| ***A63K 3/00*** | (2006.01) |
| ***A63B 71/02*** | (2006.01) |
| *A63B 65/04* | (2006.01) |
| *A63B 65/10* | (2006.01) |

(52) U.S. Cl.

CPC ..... *A63B 71/022* (2013.01); *A63B 65/04* (2013.01); *A63B 65/10* (2013.01)

(58) Field of Classification Search

CPC ..... A63B 21/00; A63B 71/022; A63B 9/00; A63B 61/00; A63B 61/003; A63B 61/04

USPC ..... 121/121, 35

See application file for complete search history.

(56) References Cited

U.S. PATENT DOCUMENTS

| | | | | |
|---|---|---|---|---|
| 2,922,653 | A * | 1/1960 | O'Brien | A63B 63/00 135/118 |
| 4,703,931 | A * | 11/1987 | Steen | A63B 69/0097 273/410 |
| 5,730,442 | A * | 3/1998 | Anderson | A63B 71/022 273/400 |
| 6,085,488 | A * | 7/2000 | Turfan | B65B 11/008 53/210 |
| D442,242 | S * | 5/2001 | Rajacich | D21/705 |
| 7,001,288 | B2 * | 2/2006 | Harrell | A63B 63/00 119/452 |
| 2016/0289998 | A1 * | 10/2016 | Huang | E04H 15/34 |

* cited by examiner

*Primary Examiner* — Loan H Thanh
*Assistant Examiner* — Megan Anderson
(74) *Attorney, Agent, or Firm* — Fidel Nwamu; Nwamu, P.C.

(57) ABSTRACT

Apparatus and method for sports throwing cage. The apparatus might be a pole with multiple curtain couplings and multiple points of contact, a support, and a bend. The curtain couplings hang a vertical net curtain. The support and the bend adapt the bent pole to provide an offset from the vertical net curtain.

12 Claims, 7 Drawing Sheets

APPARATUS AND METHOD FOR SPORTS THROWING CAGE

BACKGROUND OF THE INVENTION

The present invention relates generally to sporting apparatus and methods and more specifically to sporting apparatus and methods including sports throwing cages for use in athletic throwing events.

FIG. 1 illustrates a sports throwing cage in accordance with the prior art.

In FIG. 1, specifically, as shown, an athlete is preparing to throw an implement 160, in this case, a hammer 164. In use, the athlete typically throws the hammer 164 by making two swings from a stationary position and then three or four rotations of his or her body leading to the release of the hammer. The athlete then releases the hammer 164 towards the open end of the cage toward a field so that the thrown distance can be measured.

Sometimes upon release, an errant hammer 166 does not propel toward the open end but might head in another direction toward the audience, watchers and passersby outside the cage. When this happens, a net that encircles the cage engages the errant implement to prevent it from reaching the audience.

At other times, when the net is tied back to its supporting pole, the errant hammer 166 would strike the pole to which the net was tied. After the pole is struck, the errant hammer 166 might cause one or more dents on the pole, typically made of aluminum; and might also tear the attached net. Users would then replace one or more of the poles after several such dents. At other times, the errant hammer 166 can also ricochet back toward the athlete after striking the pole.

Moreover, as the athlete performs, the audience typically watches the athlete through the net between the supporting poles. Depending on the position of the viewing audience, some of the poles would partially obstruct the audience's view as well as the athlete's view during performance. A similar context exists for other throwing events, such as discuss throwing, etc.

It is within the aforementioned context that a need for the present invention has arisen. Thus, there is a need to address one or more of the foregoing disadvantages of conventional systems and methods, and the present invention meets this need.

BRIEF SUMMARY OF THE INVENTION

Various aspects of apparatus and methods for sports throwing cages the throwing cage system can be found in exemplary embodiments of the present invention.

In a first embodiment, the apparatus for sports throwing cages includes a pole, where one or more of the poles can be utilized to form a sports throwing cage. The pole might include multiple curtain couplings, multiple arms, a branch pole, and a support portion or base that engages the ground to hold up the pole.

The multiple curtain couplings are attached to each one of the arms to form multiple contact points for attaching a vertical curtain net. Unlike conventional throwing cages that use poles with a single arm and a single point of contact for attaching a vertical net curtain such that many poles are needed to support the vertical net curtain, the pole of the present invention considerably reduces the number of poles for the sports throwing cage by employing multiple arms and multiple points of contact on the pole for the vertical net curtain. In this manner, as the athlete performs, the audience watching the athlete through the vertical net curtain between the supporting poles would have a relatively unobstructed view because of the fewer poles employed by the present invention. The athlete similarly would have an unobstructed view for performing.

Moreover, each multiple arm is coupled to the branch pole, which is itself attached to the support at a bend. The bend is situated in the bent pole at a bend height. The support is coupled through the bend to support the arms and their curtain couplings that have a vertical net curtain forming an offset between the vertical net curtain and the support of the bent pole.

Conventional systems have little or no offset between the pole and the vertical net curtains (or curtain rope) so that the vertical net curtains can be tied back to the pole. Unlike such conventional systems, the offset between the vertical net curtains and pole of the present invention prevents the vertical net curtain from being tied back to the pole. In this manner, an errant implement or hammer thrown by an athlete cannot dent the pole, essentially eliminating significant costs associated with replacing dented poles of sports throwing cages and/or repairing the torn netting.

In a second embodiment, the apparatus includes a pole including multiple curtain couplings, a support, and a bend. The pole has a pole height and the bend is situated in the pole at a bend height.

The support is coupled to the bend to support the curtain couplings for a vertical net curtain, with a ratio of the bend height to the pole height adapting the pole to form an offset to the vertical net curtain that reduces the chance of contact between an errant implement and the pole. The curtain couplings are for hanging one or more net curtains to create a sports throwing cage to contain an implement as thrown in the athletic event.

A further understanding of the nature and advantages of the present invention herein may be realized by reference to the remaining portions of the specification and the attached drawings. Further features and advantages of the present invention, as well as the structure and operation of various embodiments of the present invention, are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail as to not unnecessarily obscure aspects of the present invention.

Figure 2:
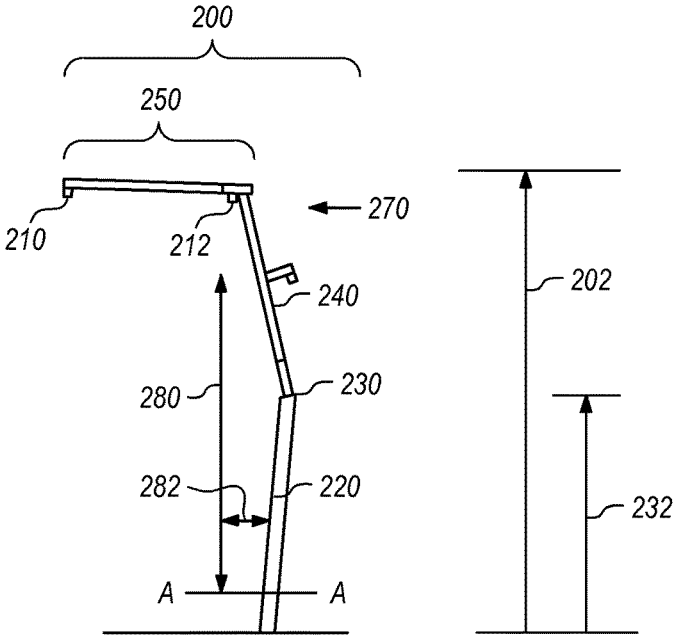
FIG. 2 illustrates a bent pole according to an exemplary embodiment of the present invention.

FIG. 2 illustrates a side view of a bent pole 200 according to an exemplary embodiment of the present invention.

In FIG. 2, as shown, bent pole 200 is tending away from a vertical net 280 that includes multiple curtain couplings 210 and 212. The bent pole 200 includes a support 220, a bend 230, and a top pole 240 that adapts the bent pole away from the vertical net. The top pole 240 is coupled to an arm 250 that includes the at least two couplings 210 and 212. The couplings 210 and 212 are adapted to hold one or more vertical nets 280 at an offset 282 from the support 220 of the bent pole 200. In some embodiments, a vertical pole can also be used with multiple curtain couplings.

The offset results from the bend 230, specifically the top pole 240 is coupled to the support 220 at the bend 230 angle. The arm 250 then attaches to the top pole 240 in a substantially horizontal direction (in one embodiment). The vertical net curtain 280 is then attached to the arm 250 at two points via net coupling 210 and net coupling 212. The vertical net curtain 280 is at an offset 282 from the support 220. This offset 282 in one embodiment, is at least 3 of feet.

The bent pole 200 may be made of aluminum, steel or other similar high tensile strength materials. The net couplings 210, 212 may similarly be made of aluminum, steel, or other high tensile strength materials. The dimensions of the pole and couplings, in one embodiment, may be based on IAAF (International Association of Athletics Federation) specifications.

The bent pole 200 has a pole height 202 and the bend 230 is situated at the bend height. The ratio of the bend height to the pole height might be between 20% and 67%. In certain embodiments, this ratio may be at least 25% and at most 60%. In certain further embodiments, this ratio may be at least 33% and at most 57%. In further embodiments, this ratio may be at least 40% and at most 53%. These ratios may also apply to the bent pole 300 of FIG. 3, bent pole 400 of FIG. 4 and/or bent pole 500 of FIG. 5.

The arrangement of the bent pole 200 and offset 284 minimize the chance that the vertical net curtain 280 rope that holds the vertical net curtain 280 in place will be tied back to the pole; as such, unlike conventional systems where there is little or no offset between the net and the ropes, the bent pole of the present invention is offset from the net so that the net cannot be tied back onto the pole. Consequently, an errant implement 166 cannot hit the bent pole or repel off the bent pole to hit and seriously injure an athlete.

Figure 3:
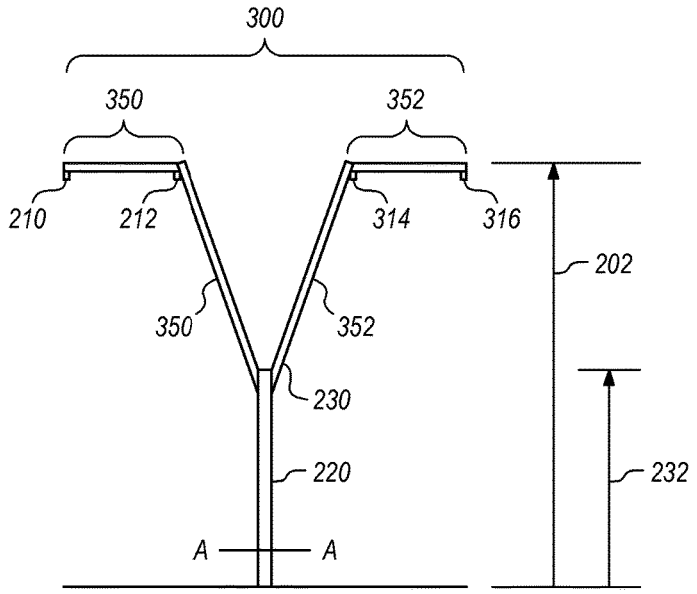
FIG. 3 illustrates a bent pole according to another exemplary embodiment of the present invention.
Figure 4:
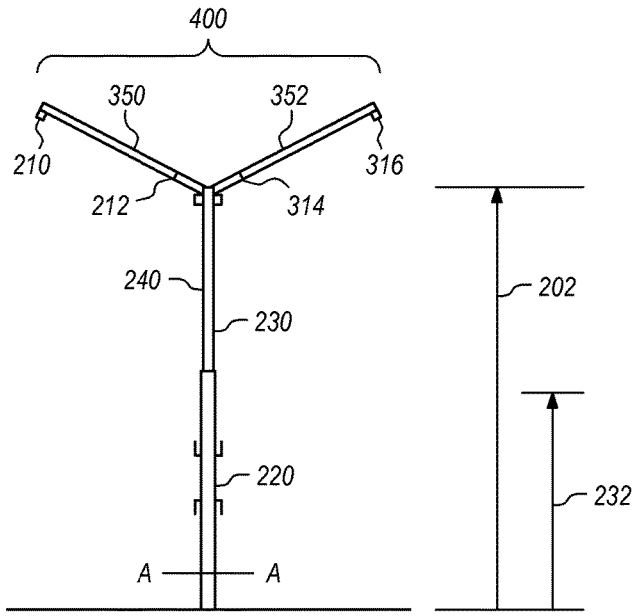
FIG. 4 illustrates a bent pole coupled to two non-horizontal arms according to another exemplary embodiment of the present invention.
Figure 5:
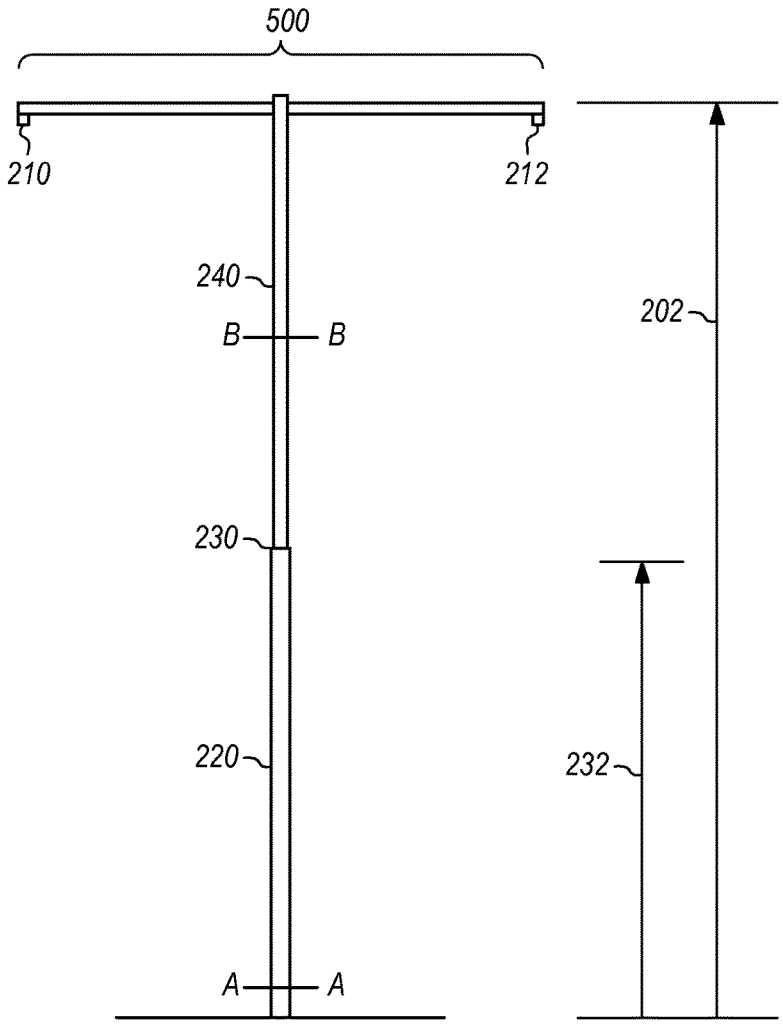
FIG. 5 illustrates a bent pole that includes two curtain couplings without an arm as shown in previous FIGS., according to another exemplary embodiment of the present invention.

This is also true for any of the embodiments 300, 400 and 500 as shown in FIGS. 3, 4, and 5. The bent pole 220 and the bent poles 300, 400 and 500 all withstand wind speed 70 of more than 74 mph and in some embodiments, wind speeds of 95 mph. These bent poles and the net curtains hung from them, do not need to be taken down until category 1 wind speeds or hurricane (74 mph) and/or cyclone (95 mph) wind speeds are encountered. In some embodiments, the bent pole may have a wind rating above 30 miles per hour (mph), or 48 kilometers per hour (kph) and can survive cyclone 2 ratings of up to 94 mph or 153 kph.

Conventional aluminum cages have low wind ratings, which means the cage's nets need to be lowered if winds exceed the cage rating (for example 20 mph). This makes cage operation labor intensive. Often the cages require framed gates that are heavy and require support wheels which are often difficult to operate to open and shut the door of the cage. Nets often get tangled and damaged in the wheel brackets.

In FIG. 2, the top pole 240 includes an arm 250 with two curtain couplings 210 and 212. In this illustration, the arm 250 is essentially horizontal. The curtain couplings 210 and 212 are adapted to vertically hang one or more net curtains 280 to create a throwing cage adapted to contain the implement 160 which will be discussed in FIG. 9 through FIG. 11. Also, a cross section A-A is shown, which will be discussed in detail regarding FIG. 6A and FIG. 6B.

In some embodiments, the pole height 202 may vary from 5.0 to 10.5 meters and the bend height 232 may vary from 2.0 to 6.0 meters. For example, when the pole height is 5.0 meters, the bend height may be 2.0 meters. Another example, when the pole height is 10.5 meters the bend height may be 6.0 meters. In some embodiments, the offset 282 may be between 0.5 meters to 1.2 meters.

The discussion of further advantages to using, constructing and operating sports cage nets based upon the embodiments 200, 300, 400 and/or 500 will be found after the FIG. 3, FIG. 4 and FIG. 5 are discussed.

FIG. 3 illustrates a face view of a bent pole 300 according to an exemplary embodiment of the present invention.

In FIG. 3, bent pole 300 includes two branch poles 360 and 362 each including a horizontal arm 350 and 352. Horizontal arm 350 includes at least two curtain couplings 210, 212. Horizontal arm 352 includes at least two curtain couplings 310 and 312. The bent pole has a profile similar to the bent pole 200 as shown in FIG. 2.

In FIG. 3, the bent pole 300 also includes support 220 and the bend 230 referenced in FIG. 2. The bent pole 300 also includes two branch poles 360 and 362 coupled through the bend 230 to the support 220 of the bent pole. Each of the branch poles includes an arm with each of the arms including two curtain couplings.

For example, branch pole 360 includes a first arm 350 including curtain couplings 210 and 212. The second branch pole 362 includes a second arm 352 further including curtain couplings 314 and 316. The cross section A-A is shown and will be discussed in detail regarding FIG. 6A and FIG. 6B. Although not shown, the apparatus may include a third branch pole, with each of the branch pole having an arm, each arm including two of the curtain couplings.

In some embodiments, the pole height 202 may be between 4.5 meters and 7.5 meters. The bend height 232 may be between 3.0 meters and 5.0 meters. For example, one bent pole 300 may have a pole height of 4.5 meters and a bend height of 3.0 meters. In another example of the bent pole 300, the pole height may be 7.5 meters and the bend height may be 5.0 meters.

In some embodiments, the branch pole 360 and/or 362 may be 2.0 to 5.0 meters long. In some embodiments, the arm 350 and/or 352 may be 2.0 to 3.5 meters long.

FIG. 4 illustrates a face view of a bent pole 400 according to another exemplary embodiment of the present invention.

In FIG. 4, specifically, bent pole 400 includes two non-horizontal arms 350 and 352 that are attached to the top pole 240. In FIG. 4, the first arm 350 includes curtain couplings 210 and 212. The second arm 352 includes curtain couplings 314 and 316. The cross section A-A is shown and will be discussed in detail regarding FIG. 6A and FIG. 6B.

FIG. 5 illustrates a face view of a bent pole 500 according to another exemplary embodiment of the present invention.

In FIG. 5, bent pole 500 includes two arms 350 and 352 that are essentially contiguous with each other. And two arms 350 and 352 are substantially horizontally disposed. A curtain coupling 210 is located at a distal end of arm 350 while a curtain coupling 212 is located at a distal end of arm 352. The proximal ends of arms 350 and 352 are coupled perpendicularly to top pole 240 at a proximal end. The other end or distal end of top pole 240 is attached to support 220 through bend 230. Here unlike the preceding embodiments, top pole 240 is contiguous with support 220 such that top pole 240 is substantially vertical (i.e., bend 230 is 180 degrees).

The cross section A-A is shown and will be discussed in detail regarding FIG. 6A and FIG. 6B. The top pole 240 is shown with a second cross section B-B that will be discussed in detail regarding FIG. 7A and FIG. 7B.

Figure 6A:
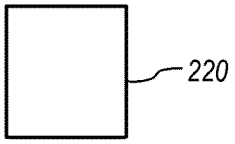
FIG. 6A illustrate alternative exemplary embodiments of the cross section A-A found in FIG. 2 to FIG. 5 of the present invention.

FIG. 6A illustrates an exemplary embodiments of the cross section A-A found in FIG. 2 to FIG. 5 of the present invention. In FIG. 6A, the cross section of the support 220 of any of the embodiments of FIG. 2 to FIG. 5 may be rectangular and/or square.

Figure 6B:
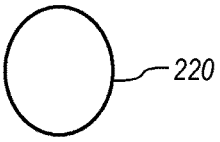
FIG. 6B illustrate alternative exemplary embodiments of the cross section A-A found in FIG. 2 to FIG. 5 of the present invention.

FIG. 6B illustrates an alternative exemplary embodiment of the cross section A-A found in FIG. 2 to FIG. 5 of the present invention. In FIG. 6B, the cross section of the support 220 of any of the embodiments of FIG. 2 to FIG. 5 may be round.

Figure 7A:
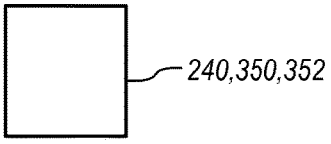
FIG. 7A illustrate alternative exemplary embodiments of the cross section B-B found in FIG. 5 and applicable to the top pole as found in FIG. 2 and FIG. 4, as well as applicable to one or both of the branch poles of FIG. 3.

FIG. 7A illustrates an exemplary embodiment of the cross section B-B of FIG. 5. This cross section B-B may also be that of top pole 240 (FIG. 2 and FIG. 4) and branch poles 360 and 362 of FIG. 3.

In FIG. 7A, the cross section B-B of top pole 240 of FIG. 2, FIG. 4 and/or FIG. 5 is rectangular and/or square. The cross section of the branch pole 360 and/or the branch pole 362 of FIG. 3 may also be rectangular and/or square.

Figure 7B:
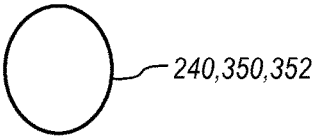
FIG. 7B illustrate alternative exemplary embodiments of the cross section B-B found in FIG. 5 and applicable to the top pole as found in FIG. 2 and FIG. 4, as well as applicable to one or both of the branch poles of FIG. 3.

FIG. 7B illustrates another exemplary embodiment of the cross section B-B of FIG. 5. This cross section may also be that of top pole 240, FIG. 2 and FIG. 4, as well as that of the branch poles 360 and 362 of FIG. 3.

In FIG. 7B, the cross section B-B of the any of the embodiments of the top pole 240 of FIG. 2, FIG. 4 and/or FIG. 5 may be round. The cross section of the branch pole 360 and/or the branch pole 362 of FIG. 3 may also be round.

Figure 8:
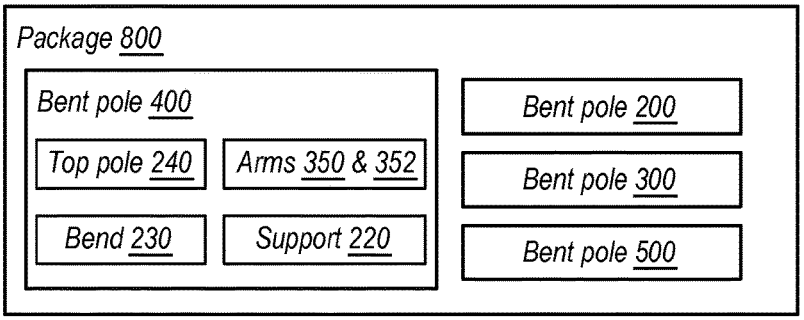
FIG. 8 illustrates a package to create at least one of the bent poles of FIG. 2 to FIG. 5 according to an exemplary embodiment of the present invention.

FIG. 8 illustrates a package 800 to create at least one of the bent poles 200, 300, 400 and/or 500 of FIG. 2 to FIG. 5 according to an exemplary embodiment of the present invention.

In FIG. 8, package 800 may include components to create the bent pole 400 of FIG. 4. These components may include any combination of the support 220, bend 230, top pole 240, the first arm 350 and/or the second arm 352. Note that in some embodiments, the support 220 and the bend 230 may be manufactured as a single component. In other embodiments, the package 800 may include components for the bent pole 200 of FIG. 2.

These components may include any combination of the support 220, bend 230, top pole 240, the arm 350, and/or the curtain couplings 210 and/or 212. In other embodiments, the package 800 may include components for the bent pole 200 of FIG. 3. These components may include any combination of the support 220, the bend 230, the first branch pole 360, the second branch pole 362, the first arm 350, the second arm 352, and/or the curtain couplings 210, 212, 314 and/or 316.

Note that in some embodiments, the first branch pole 360 and the second branch pole 362 may be manufactured as a single unit. Further note, in some embodiments, the bend 230, the first branch pole 360 and the second branch pole 362 may be manufactured as a single unit. In other embodiments, the package 800 may include components for the bent pole 500 of FIG. 5. These components may include any combination of the support 220, bend 230, top pole 240, and/or the curtain couplings 210 and/or 212.

Figure 1:
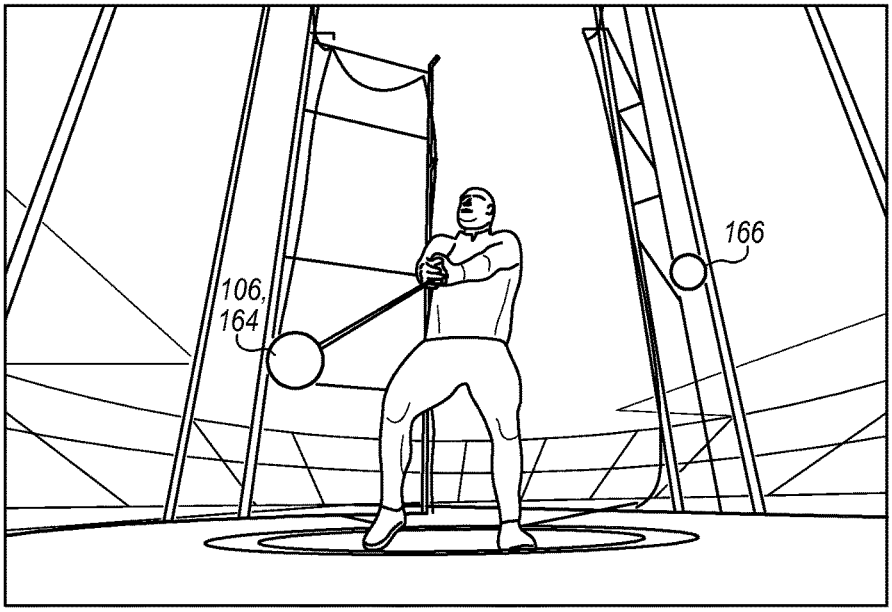
FIG. 1 Prior Art
FIG. 1 illustrates a prior art throwing cage with an athlete preparing to throw an implement, in this case, a hammer.
Figure 9:
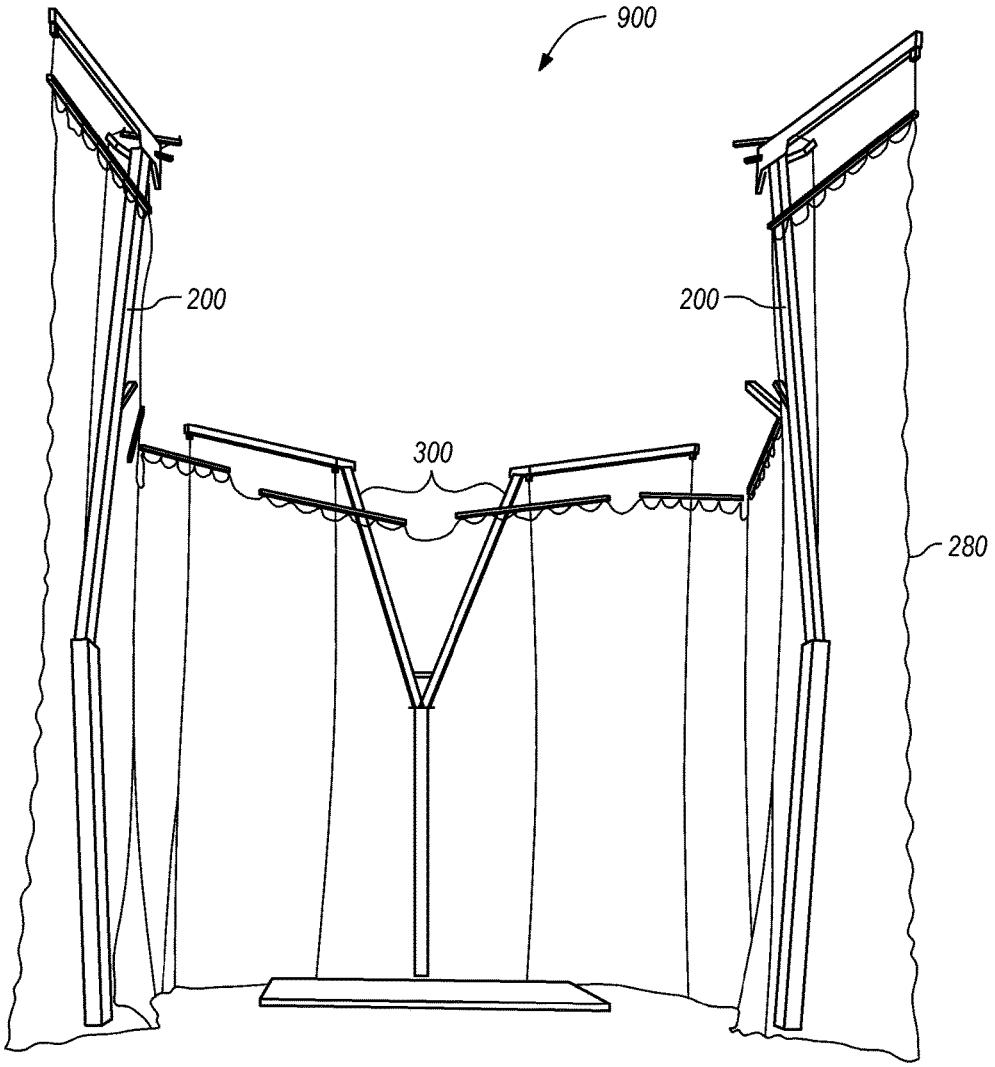
FIG. 9 illustrates a sports throwing cage adapted for athletes throwing the hammer according to an exemplary embodiment of the present invention.

FIG. 9 illustrates a sports throwing cage 900 for throwing the hammer 164 as shown in FIG. 1 according to an exemplary embodiment of the present invention.

In FIG. 9, the sports throwing cage 900 includes the bent pole 300 and two bent poles 200, collectively supporting the vertical net curtain 280 adapted so that the implement 160 being thrown does not contact and damage the bent poles, nor hit the athlete by bouncing off the bent pole. The net curtain hangs vertically and the bent poles 200 and 300 are adapted away by vertical offsets 282 from the vertical net curtain as shown in FIG. 2, which protects the bent poles from contact with an errant implement 166 as shown in FIG. 1 of the prior art.

Figure 10:
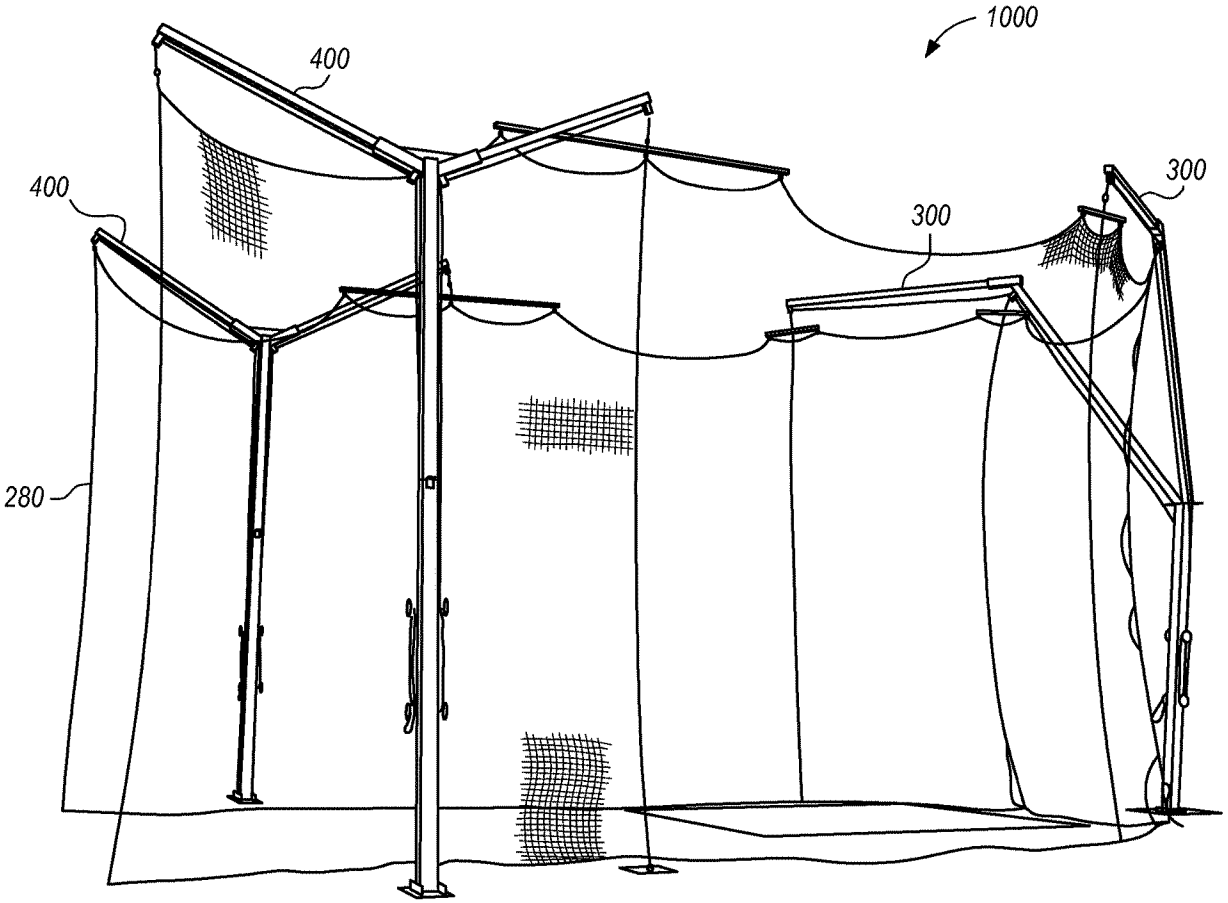
FIG. 10 illustrates a sports throwing cage adapted for the game of throwing the discus according to an exemplary embodiment of the present invention.
Figure 11:
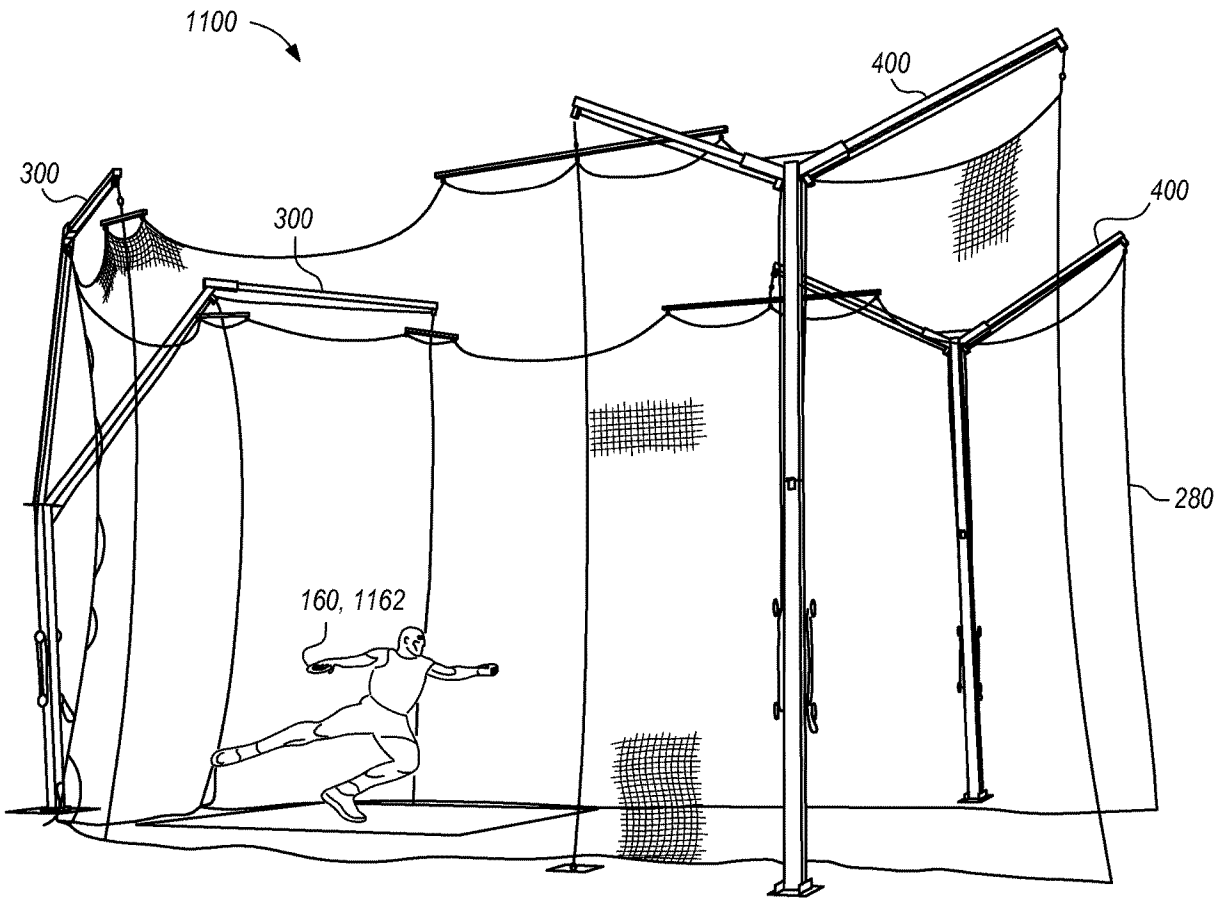
FIG. 11 illustrates a sports throwing cage adapted for the game of throwing the discus according to a second exemplary embodiment of the present invention.

FIG. 10 illustrate a sports throwing cage 1000 adapted for the game of throwing the discus 1162 as shown in FIG. 11 according to an exemplary embodiment of the present invention.

In FIG. 10, the sports throwing cage 1000 includes the bent pole 300 of FIG. 3 and two of the bent poles 400 of FIG. 4. These bent poles collectively support the vertical net curtain 280, which hangs vertically from the couplings 210, 212, 314, and 316 as shown in FIG. 3 and FIG. 4. The vertical net curtain 280 hangs vertically and the bent poles are adapted away from the vertical by the offset 282 which protects the bent poles from contact with an errant implement 166 (FIG. 1).

FIG. 11 illustrates a sports throwing cage 1100 adapted for the game of throwing the discus 1162 according to another exemplary embodiment of the present invention.

In FIG. 11, the sports throwing cage 1100 includes the bent pole 300 of FIG. 3 and two of the bent poles 400 of FIG. 4. These bent poles collectively support the vertical net curtain 280, which hangs vertically from the couplings 210, 212, 314, and 316 as shown in FIG. 3 and FIG. 4.

In another embodiment of the present invention, the apparatus for sports throwing cages includes a package 800 to create at least one of the bent poles 200, 300, 400, and/or 500. The package may further include components such as a support 220, a bend 230, a top pole 240, a branch pole(s) 360 and/or 352, an arm(s) 350 and/or 352 and/or curtain couplings 210, 212, 314 and/or 316.

In another embodiment, a method includes at least one of the following: The method may include installing a bent pole tending away from vertical and including multiple curtain couplings to minimize contact between an errant implement and the bent pole. The multiple curtain couplings may be adapted to hang one or more net curtains to create a throwing cage adapted to contain the errant implement away from the bent pole as thrown in an athletic event.

The method may include operating the throwing cage without a concrete apron to support the bent pole. The method may include using the throwing cage during the athletic event to improve a spectator's view of an athlete competing in the athletic event throwing the implement. And/or the method may include leaving the throwing cage operational until wind speed approaches 74 mph, and in some situations, until the wind speed approaches 95 miles per hour.

While the above is a complete description of exemplary specific embodiments of the invention, additional embodiments are also possible. Thus, the above description should not be taken as limiting the scope of the invention, which is defined by the appended claims along with their full scope of equivalents.

I claim:

1. An apparatus comprising:

a pole, at least one arm attached to the pole, the at least one arm comprising a plurality of curtain couplings adapted to vertically hang a vertical net curtain to create a sports throwing cage to contain an implement as thrown in an athletic event, wherein said plurality of curtain couplings create at least two points of contact on the pole to hang said vertical net curtain; wherein said pole further includes a plurality of branch poles coupled to a bend in the pole, such that the at least one arm is attached to one of the plurality of branch poles.

2. The apparatus of claim 1, further comprising: a second arm coupled to said pole, said second arm coupled to at least two curtain couplings of the plurality of curtain couplings.

3. The apparatus of claim 1, wherein said at least one arm is substantially horizontal.

4. An apparatus comprising:

a pole including at least one arm, the at least one arm comprising a plurality of curtain couplings adapted to vertically hang a vertical net curtain to create a sports throwing cage to contain an implement as thrown in an athletic event, wherein said plurality of curtain couplings create at least two points of contact on the pole to hang said vertical net curtain, wherein said pole includes a support, a top pole and a bend, with said pole having a pole height and said bend situated in said pole at a bend height, and wherein said support is coupled through said bend to the top pole and the at least one arm coupled to the plurality of curtain couplings and adapted to hang the vertical net curtain; and said pole being adapted to form an offset between said pole and said vertical net curtain.

5. The apparatus of claim 4, further comprising: a package having at least said pole.

6. The apparatus of claim 5, further comprising: said sports throwing cage including a second pole.

7. The apparatus of claim 6, wherein said second pole supports a multiplicity of branch poles, wherein each of said multiplicity of branch poles supports a respective at least one arm, wherein each of the at least one arms of said multiplicity of branch poles include at least two of said plurality of curtain couplings.

8. The apparatus of claim 7, wherein said sports throwing cage includes a third pole, the third pole including a horizontal arm supporting at least two of said plurality of curtain couplings.

9. The apparatus of claim 4, further comprising: said support having a rectangular cross section or a round cross section for at least part of a length of said bent pole.

10. An apparatus comprising:

a pole including at least one arm and a plurality of curtain couplings adapted to vertically hang a vertical net curtain to create a sports throwing cage to contain an implement as thrown in an athletic event, wherein said plurality of curtain couplings create at least two points of contact on the pole to hang said vertical net curtain, the at least one arm comprising a multiplicity of arms coupled to said pole, each of said multiplicity of arms coupled at least two of said plurality of curtain couplings, and a multiplicity of branch poles, coupled to the pole, wherein each of said multiplicity of branch poles supports at least one of said multiplicity of arms, each of the multiplicity of arms coupled to at least two of said plurality of curtain couplings.

11. An apparatus comprising:

a pole including at least plural arms each of the at least plural arms including a plurality of curtain couplings adapted to vertically hang a vertical net curtain to create a sports throwing cage to contain an implement as thrown in an athletic event, wherein said plurality of curtain couplings create at least two points of contact on the pole to hang the vertical net curtain, wherein said pole includes a support, a top pole and a bend, with said pole having a pole height and said bend situated in said pole at a bend height, wherein said support is coupled through said bend to the top pole that supports the at least plural arms having said plurality of curtain couplings adapted to hang the vertical net curtain; and adapting said pole to form an offset between said pole and said vertical net curtain.

12. The apparatus of claim 11 further comprising: a multiplicity of branch poles coupled to the pole, wherein each of said multiplicity of branch poles supports at least one of said at least plural arms, each of the at least plural arms including at least two of said plurality of curtain couplings.

* * * * *